United States Patent [19]

Myers

[11] 4,018,185

[45] Apr. 19, 1977

[54] POWDER FEEDER PICK-UP TUBE

[75] Inventor: James Lewis Myers, Golden, Colo.

[73] Assignee: Coors Container Company, Golden, Colo.

[22] Filed: Dec. 15, 1975

[21] Appl. No.: 640,396

[52] U.S. Cl. ..... 118/308; 118/DIG. 5; 118/629

[51] Int. Cl.[2] ..... B05B 7/14

[58] Field of Search ..... 118/308, 309, 311, 303, 118/634, 629, DIG. 5; 427/421; 302/17, 29, 45; 222/3, 195; 239/654

[56] References Cited

UNITED STATES PATENTS

| | | | |
|---|---|---|---|
| 1,585,990 | 5/1926 | Houghton | 118/308 X |
| 2,093,995 | 9/1937 | Blow | 118/308 X |
| 2,242,182 | 5/1941 | McCann | 118/308 X |
| 3,100,724 | 8/1963 | Rocheville | 118/308 |
| 3,139,044 | 6/1964 | Cole | 118/309 X |
| 3,472,201 | 10/1969 | Quackenbush | 118/308 |
| 3,880,116 | 4/1975 | Prillig et al. | 118/303 |

*Primary Examiner*—Louis K. Rimrodt
*Attorney, Agent, or Firm*—MacGregor and Rost

[57] ABSTRACT

A powder feeder pick-up tube having a central powder delivery tube receiving powder entrained in a propellant gas, an outer concentric tube delivering propellant gas to the powder delivery tube and evenly entraining powder in the gas as the powder enters the powder delivery tube. The propellant delivery tube has an inwardly curving end that forms a gap with the open end of the powder delivery tube, and the geometry of the curving end and the size of the gap are factors determining the operational characteristics of the pick-up tube. Variations on the basic pick-up tube include a concentric fluidizing tube surrounding the propellent delivery tube and locally fluidizing powder around the opening of the powder pick-up tube. The shape of the fluidizing orifice at the outlet of the fluidizing tube may be modified to alter its fluidizing characteristics. The tube is immersed in a hopper of powder when operating and the entire hopper may be fluidized and vibrated to assist the operation of the pick-up tube. Passing fluidizing gas through the fluidizing tube allows a reserve tube to remain immersed in a powder hopper without clogging when not in use.

12 Claims, 7 Drawing Figures

POWDER FEEDER PICK-UP TUBE

BACKGROUND OF THE INVENTION

1. Field of the Invention

The invention relates to powder pick-up tubes for use in delivering finely divided particles entrained in a suitable gas from a bulk container to a point of use. Although the invention is capable of delivering powder over a wide range of particle sizes, it is particularly useful with very finely divided particles that are normally extremely difficult to feed uniformly because of their tendency to agglomerate due to moisture pick-up and also electrostatic and van der Wal forces.

2. Description of the Prior Art

Devices of somewhat similar structure have been used in hydraulic excavation of river bottoms, although the purpose and structure of these devices was merely to raise gravel or ore deposits to an accessable location without regard to uniform delivery rate and without dealing with the problems characteristic of powder delivery systems.

Other powder delivery systems such as U.S. Pat. No. 3,472,201 to Quackenbush rely on the negative pressure within a hose to sweep in powder, but the present invention is believed to offer superior uniformity of delivery and better ability to break up agglomerations of the powder.

SUMMARY OF THE INVENTION

The present invention relates to powder feeders for delivering a uniform flow of finely divided powder for use in equipment such as powder coating apparatus. More specifically, the invention relates to powder pick-up tubes that deliver a uniform flow of powder and break up agglomerations of powder in the process of picking up and feeding the powder to its point of use. The device is intended to be used with a propellant gas and may include fluidizing means to better prepare the bulk powder for pick up.

An object of the invention is to deliver a uniform flow of finely divided powder to a point of use. Another important object is to break up agglomerations of powder and keep the particles dispersed in the entraining gas.

DESCRIPTION OF THE PREFERRED EMBODIMENT

Figure 1:
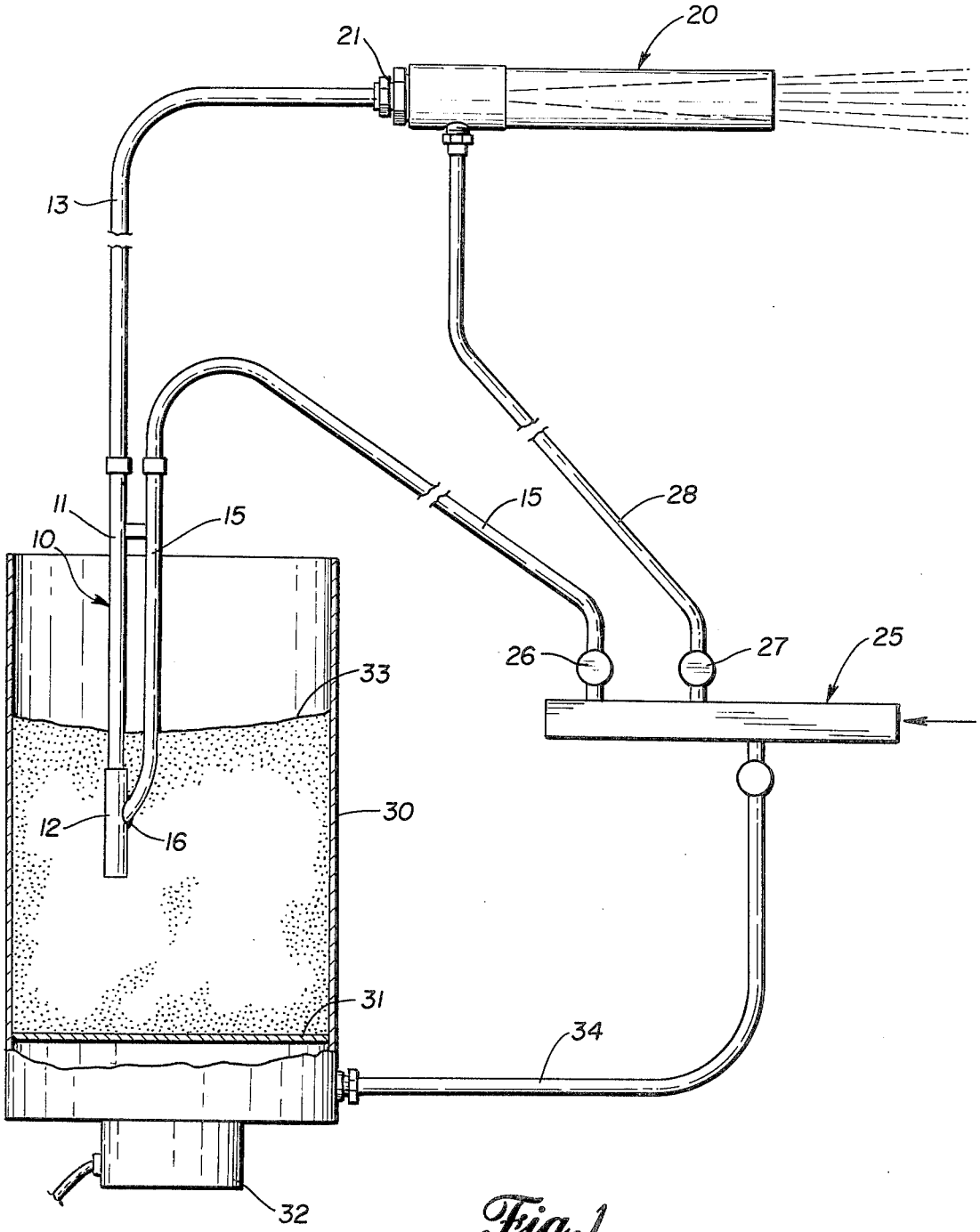
FIG. 1 is an elevational view of a typical system embodying the powder feeder pick-up tube of this invention.
Figure 2:
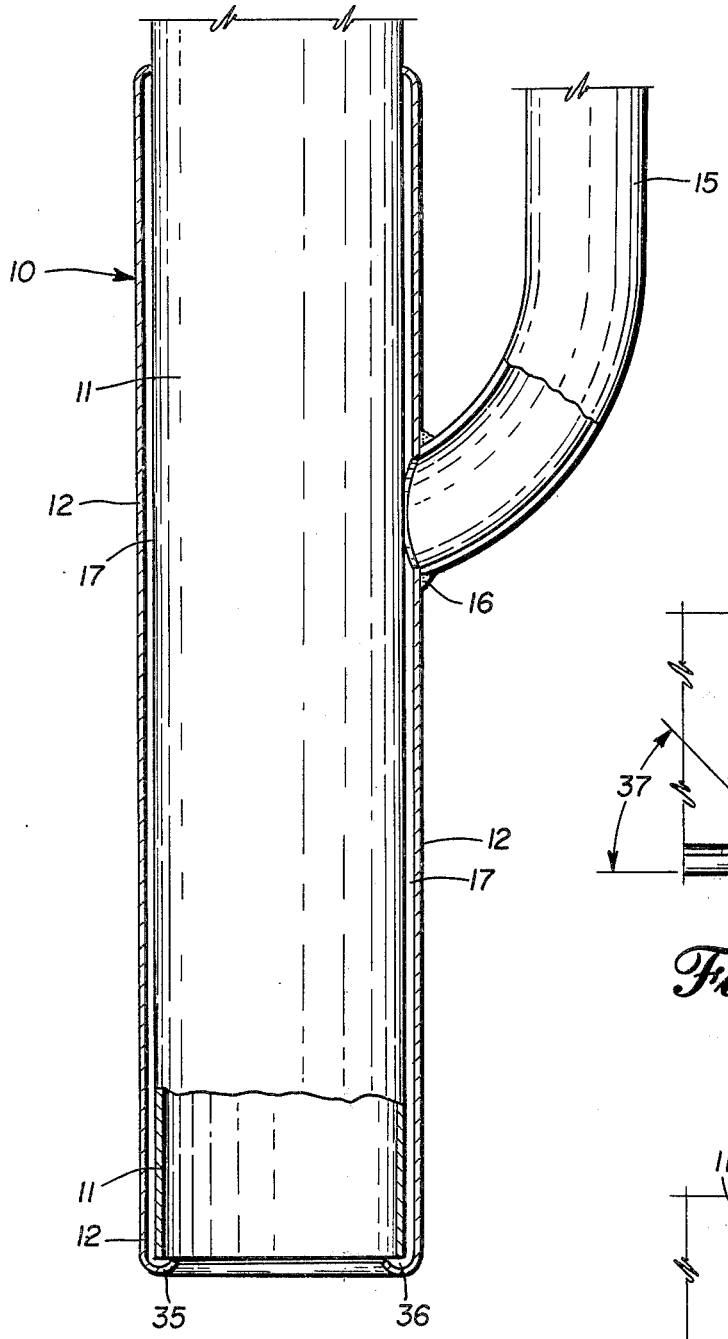
FIG. 2 is an enlarged vertical sectional view of a part of the powder pick-up tube and gas supply tube.

The pick-up tube 10 as shown in FIGS. 1 and 2 comprises a pair of tubes 11 and 12, which may be concentric, to deliver propellant gas to the opening of powder delivery tube 11. Propellant delivery tube 12 carries the propellant gas to the opening of tube 11, where means for directing the gas causes the gas to flow into the opening of tube 11, which is typically immersed in the powder to be delivered. The gas flow into the pick-up end of tube 11 may create a negative pressure that will entrain finely divided particles of powder in the gas. The propellant gas then travels through upper delivery tube 13 carrying powder entrained in gas to its point of use. Propellant delivery tube 12 receives compressed gas through gas supply tube 15. When the tubes 11 and 12 are concentric, the gas supply tube 15 joins propellant delivery tube 12 at connection 16 and the gas is delivered through the annular space 17 between tubes 11 and 12 to the lower end of pick-up tube 10. The pick-up tube 10 may typically be used to supply a uniform flow of fine powder to a device such as gun 20 connected to upper tube 13 at coupling 21.

Gas for the operation of the pick-up tube and associated apparatus is supplied by gas manifold 25 which supplies compressed gas to tube 15 via connection 26 and also may supply gas via connection 27 to conduit 28 for the operation of gun 20.

The pick-up tube may be used in a powder hopper 30 that may be equipped with means for fluidizing the powder and preventing channeling as the pick-up tube removes powder. Said means may include a fluidizing plate 31 or a vibrator 32, both of which aid in handling the pick-up of powder 33. Conduit 34 operates in cooperation with fluidizing plate 31 by delivering fluidizing gas from gas manifold 25 to hopper 30 below plate 31.

Figure 3:
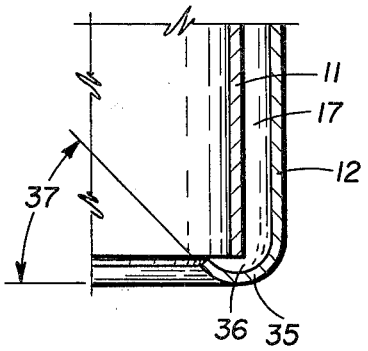
FIG. 3 is an enlarged vertical sectional view of the lower end of the powder delivery tube.
Figure 4:
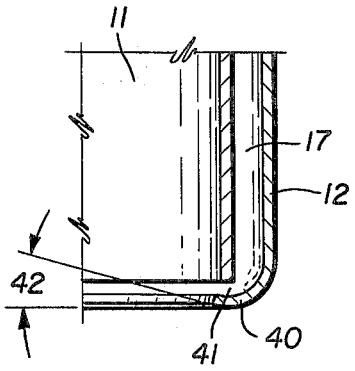
FIG. 4 is an enlarged vertical sectional view of the lower end of the powder delivery tube showing a modified end of propellant delivery tube.

In FIGS. 3 and 4 the gas delivered by gas supply tube 15 to annular space 17 exits at the curved lower end 35 or 40 of outer tube 12 through gap 36 or 41. For a given quantity of gas flow the gas velocity is determined by the diameter of the tubes 11 and 12 and the size of gap 36 or 41. Beyond this point the characteristics of the air flow are determined by angle 37 or 42 formed by curve 35 or 40, respectively. The angle may be positive or negative as the application requires. The device could act as an aspirator and deliver the powder at a positive pressure at the output end of tube 13, or it could act as a passive device requiring suction on the output end of tube 13 depending upon, among other factors, the angle 37 or 42. In either case the propellant gas directed through angle 37 or 42 forms a converging conical jet of high velocity that not only provides suction at the pick-up end of 10, but also separates particles that have agglomerated and keeps them dispersed in the entraining gas. The desired process is to break up the agglomerates into individual particles without regard to the number of particles in the agglomerate. In addition to the accuracy of powder delivery, the other two characteristics of powder flow which must be controlled is the weight per unit time of powder delivery and the weight ratio of powder to the air in which it is entrained. This last factor in conjunction with conduit size determines if the powder flow from the pick-up point to the point of use is one phase or two phase. One phase flow, having the powder fully entrained, is more desirable because two phase flow can itself cause decreased delivery accuracy. The powder to gas weight ratio is primarily determined by the degree of fluidization or the density of the powder at the time of pick-up by the tube 10. Depending on the configuration of angle 37 or 42 and gap 36 or 41 at the pick-up end of 10, the gas can flow from the tube 10 to locally fluidize the powder. In FIG. 3 angle 37 is larger than angle 42 of FIG. 4. The greater angle 37 provides more pumping action to pick up powder, while the smaller angle 42 provides more gas in the supplied mixture of gas and powder. Increasing the gap size will also increase the proportion of gas in the mixture. Thus, if gap 41 is greater than gap 36 and angle 42 is less than angle 37, the configuration of FIG. 4 will entrain far less powder per volume of gas than is achieved in the configuration of FIG. 3. Suitable angles include, for example, a maximum of approximately 80° above the horizontal to a minimum of 30° below the horizontal.

When suction is applied at the output end of tube 13, the gas pressure applied at the gas supply tube 15 determines the degree of fluidization, the strength of the deagglomeration process and the quantity of powder flow. When the configuration of the tube 10 is such as to act as an aspirator and no suction is applied at the output end, the operating characteristics within any one system are a function only of supply gas pressure. This makes the tube 10 less versatile but simpler to control. The tube 10 can also be operated as an aspirator in conjunction with suction at the output end. This configuration is most likely for general use.

When the device as described is used with powders with good dry flow characteristics, the device is useful alone. In other powders, fluidizing by directing gas through fluidizing plate 31 is needed to improve handling characteristics. The use of vibrator 32 on the hopper 30 will usually prevent channeling. Some powders have been observed to tribo-charge themselves by interaction with the hopper wall, the fluidizing gas, or other powder particles. In this instance the mutual repulsion of particles carrying like charges assists in keeping the fluid bed uniform. If this feature is desired but the powder has poor tribo-charging characteristics, an external source of high voltage may adequately charge the hopper.

Figure 5:
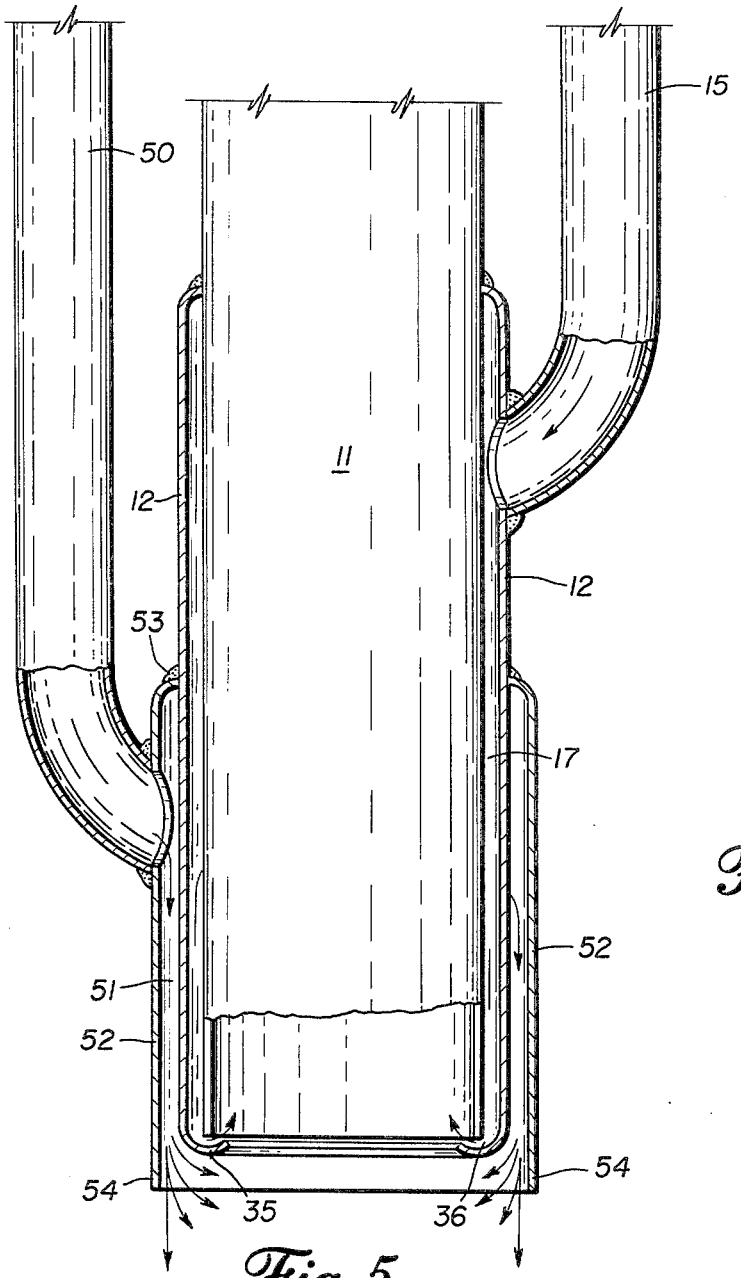
FIG. 5 is an enlarged vertical sectional view of a modified powder delivery tube, propellant delivery tube, and a fluidizing tube.
Figure 6:
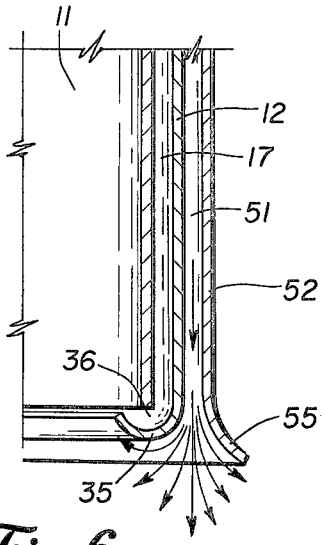
FIG. 6 is an enlarged vertical sectional view of the lower end of the powder delivery tube showing a modified end of the fluidizing tube and the propellant delivery tube.
Figure 7:
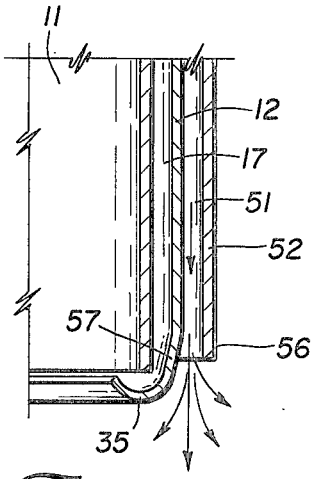
FIG. 7 is an enlarged vertical sectional view of the powder delivery tube showing another modification of the end of the fluidizing tube and the propellant delivery tube.

Local fluidization alone or local fluidization in conjunction with general fluidization of the hopper 30 may give more uniform feeding of powder. FIGS. 5, 6 and 7 show means for local fluidization by gas supplied by tube 50 to a second narrow annular area 51 between the walls of tube 12 and a third concentric tube 52 attached to the outer wall of tube 12 at 53. The gas supply to tube 52 is preferably controlled independently from the propellant gas to tube 12. The extent of local fluidization is determined in part by the configuration of the fluidizing orifice formed by curve 35 and tube end 54. The configuration of FIG. 5 will tend to sweep powders toward the inlet since the expanding gas as it exits the fluidizing orifice will attach itself to the inwardly curving wall 35 as shown by the arrows due to the coanda effect as long as the flow is laminar. If the gas velocity is sufficiently high, the flow will become turbulent and detach, as is well known in the art, and the sweeping effect will be lost. As tube end 54 is extended beyond curve 35, the inward component of gas motion is increased and less of the powder in which the device is immersed is involved in the fluidized region. When tube end 54 is shortened the sweeping effect is reduced but the locally fluidized region is enlarged. The tube end 54 may be flared outwardly 55 in FIG. 6, reducing the inward sweeping motion and enlarging the locally fluidized region.

In FIG. 7 the inner wall of the fluidizing orifice formed by tube 12 should not deviate in shape from that of a semitoroidal tangent radius, as by bend 57 in FIG. 7. If bend 57 exceeds approximately 15°, the Kamm effect will take over and the gas stream will detach from the wall and turbulence will disrupt the feeder section's operation.

The configuration of FIG. 5 offers an added advantage of being suited to act as a spare or reserve pick-up tube to be activated if another source of powder is suddenly needed. In order to be most useful, such a reserve tube must be immersed in the powder and ready to operate immediately upon activation, but powder tends to enter such a non-operating tube and clog the entrance if the tube is not supplied with some propellant gas. By supplying the configuration of FIG. 5 with low pressure fluidizing gas through area 51, the pick-up tube is kept primed for immediate activation and does not clog with powder while not activated.

I claim:

1. A powder feeder pick-up tube for use with a supply of compressed propellant gas and a hopper containing finely divided powder, comprising a. a powder delivery tube carrying powder entrained in propellant gas from said hopper to a point of use and having an open end for receiving the powder and propellant gas, b. a propellant delivery tube concentric with said powder delivery tube and forming an annular area between the walls of the two tubes, the annular area having an orifice adjacent the opening of the powder delivery tube for delivering propellant gas through said orifice c. means directing the gas flow from the propellant delivery tube through said orifice and into a converging conical jet of high velocity gas for deagglomerating powder from said hopper and evenly entraining the powder in the gas, and d. means supplying said propellant gas to the propellant delivery tube from said supply of compressed propellant gas.

2. The pick-up tube defined in claim 1, wherein the outer tube bounding said annular area is the propellant delivery tube and the inner tube bounding said annular area is the powder delivery tube.

3. The pick-up tube defined by claim 2, wherein the means directing the gas flow into a converging conical jet comprises a portion of the propellant delivery tube curving inwardly at a predetermined angle and forming a gap of predetermined width, the size of the angle and the size of the gap influencing the powder-to-gas weight ration in the powder delivery tube.

4. The pick-up tube defined by claim 3, wherein said predetermined angle of the inwardly curving end of the propellant delivery tube is between an upper limit of 80° above the horizontal and a lower limit of 30° below the horizontal, angles relatively closer to the upper limit increasing the pumping action of the pick-up tube on the powder.

5. The powder feeder pick-up tube described in claim 1, further comprising fluidizing means for improving the handling characteristics of said powder in said hopper.

6. The powder feeder pick-up tube of claim 5, wherein the fluidizing means comprises a fluidizing plate located in said hopper and under said powder, a supply of compressed gas, and means connecting said supply of compressed gas and said hopper under said fluidizing plate.

7. The powder feeder pick-up tube of claim 6, wherein the fluidizing means further comprises a vibrator attached to said hopper for vibrating said powder in conjunction with the operation of the fluidizing plate.

8. The powder feeder pick-up tube of claim 5, wherein the fluidizing means comprises a source of high voltage attached to said hopper for charging said powder.

9. A powder feeder pick-up tube for use with a supply of compressed propellant gas and a hopper containing finely divided powder comprising a. a first tube delivering powder entrained in said propellant gas to a point of use and having an opening for receiving said powder and propellant gas, b. a second tube concentric with and exterior to said first tube and forming a first annular area between the walls of the two tubes and having an opening delivering said propellant to said opening of the first tube, and having an inwardly curving end directing said propellant gas into said opening of the first tube, c. means connecting said second tube to said supply of compressed propellant gas delivering said propellant gas to the annular area formed by the first and second tubes, d. a third tube concentric with and exterior to said second tube and forming a second annular area between the walls of the second and third tubes, said second annular area forming a fluidizing orifice at its opening delivering fluidizing gas to the general area of said opening of the first tube, e. a supply of fluidizing gas, and f. means connecting said supply of fluidizing gas with said third tube for carrying the fluidizing gas to said second annular area.

10. The powder feeder pick-up tube of claim 9, wherein said third tube extends axially beyond said curved end of the second tube for directing fluidizing gas both toward the opening of said first tube and downwardly into said powder hopper for fluidizing powder locally.

11. The powder feeder pick-up tube of claim 9, wherein said third tube extends downwardly and flares outwardly from said curved end of the second tube for fluidizing powder locally.

12. The powder feeder pick-up tube of claim 9, wherein the end portion of said third tube and the end portion of said second tube form a fluidizing orifice in the general shape of a semi-toroidal tangent radius with the end wall of the second tube adjacent to said inwardly curving portion being inwardly inclined not to exceed 15°.

* * * * *